US006615562B2

(12) United States Patent
Fritsche et al.

(10) Patent No.: US 6,615,562 B2
(45) Date of Patent: Sep. 9, 2003

(54) BOX FRAME ASSEMBLY

(75) Inventors: Mark Fritsche, Eagan, MN (US); Dan Berg, Minneapolis, MN (US); Jason Johnson, Minneapolis, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

(21) Appl. No.: 09/953,111

(22) Filed: Sep. 13, 2001

(65) Prior Publication Data

US 2003/0046893 A1 Mar. 13, 2003

(51) Int. Cl.[7] ..... E04H 12/00; E04C 3/30

(52) U.S. Cl. ..... 52/696; 52/690; 52/730.1; 52/731.1

(58) Field of Search ..... 52/690, 696, 730.1, 52/731.1, 651.03, 651.01, 651.08; 248/163.1, 172, 188.8, 188.1, 677; 403/169, 170, 171; 211/187

(56) References Cited

U.S. PATENT DOCUMENTS 767,533 A * 8/1904 Warner ..... 52/651.08
1,939,598 A * 12/1933 Ragsdale ..... 52/650.1
3,374,977 A * 3/1968 Moy
4,658,560 A 4/1987 Beaulieu
5,317,325 A * 5/1994 Bottomley
5,351,843 A 10/1994 Wichman et al.
5,584,156 A 12/1996 Lange
5,588,274 A 12/1996 Lange
5,706,622 A 1/1998 Lange
5,711,131 A * 1/1998 Thomas
5,822,945 A 10/1998 Muller
6,026,626 A * 2/2000 Fisher ..... 52/633
6,079,178 A * 6/2000 Fisher
6,149,021 A 11/2000 Beaulieu
6,241,108 B1 * 6/2001 Nakatani et al. ..... 211/187
6,364,138 B1 * 4/2002 Chen ..... 211/187
6,408,587 B2 * 6/2002 Cronin et al. ..... 52/637

OTHER PUBLICATIONS

Skyline Displays, Inc., *ps2000 brochure*, 2001.
Skyline Displays, Inc., *imagine that. brochure*, 2000.
Skyline Displays, Inc., *design ideas brochure*,2000.
Skyline Displays, Inc., *How Do You Market Your e–Business Offline? brochure*, 2001.
Skyline Displays, Inc., *mirage plus brochure*, 2001.
Skyline Displays, Inc., *skytruss brochure*, 2001.
Trussworks, Truss Catalog web page printout, *Truss Parts*, Aug. 17, 2001.
Trussworks, Truss Catalog web page printout, *Trussworks Photos, Graphics Frame*, p. 1, Aug. 17, 2001.
Trussworks, Truss Catalog web page prinout, *Trussworks Photos, Graphics Frame*p. 2, Aug. 17, 2001.
Trussworks, Truss Catalog web page printout, *Trussworks Photos, Exhibit Photos*, p. 1, Aug. 17, 2001.
Trussworks, Truss Catalog web page printout, *Trussworks Photos, Graphics Frame*, p. 12 Aug. 17, 2001.

* cited by examiner

*Primary Examiner*—Carl D. Friedman
*Assistant Examiner*—Kevin McDermott
(74) *Attorney, Agent, or Firm*—Patterson, Thuente, Skaar & Christensen, P.A.

(57) ABSTRACT

The elongated box frame structure of the present invention comprises a plurality of frame segments attached to at least one end piece. Preferably, two end pieces are attached, one at each end of the plurality of frame segments. The plurality of frame segments are attached to the end piece such that a column-like structure is formed. The inner space defined within the frame segments is substantially free of webbing. Instead, structural strength and stability is achieved by the attached end pieces. The end pieces of one elongated box frame structure are capable of removably connecting with the end piece of other similar elongated box frame structures to achieve varying framing heights and other dynamic configurations.

19 Claims, 5 Drawing Sheets

BOX FRAME ASSEMBLY

The U.S. Patent Applications are being filed by the same applicant on the same day as this application and are hereby incorporated by reference: U.S. Patent Application No. 09/953,098, entitled "DISPLAY WITH APPURTENANCE ATTACHMENT"; U.S. Patent Application No. 09/953,099, entitled "SCREEN MOUNTING APPARATUS"; U.S. Patent Application No. 09/953,113, entitled "MODULAR MULTI-CONFIGURABLE DISPLAY SYSTEM".

FIELD OF THE INVENTION

The present invention relates to displays, and in particular, to an elongated box frame assembly for use in display exhibit configurations.

BACKGROUND OF THE INVENTION

In the construction of exhibit and display stands at trade shows, it is a conventional practice to utilize various truss and frame structures to assist in erecting and configuring the walls that create the backdrop for a particular vendor's defined booth space. Typically, column and truss structures are designed so that they are readily collapsible for transportation to and from trade shows.

With this collapsibility design preference comes requisite structural features. Intermediate webbing and other forms of cross membering often provide collapsible pivot points for erecting and collapsing the frames. In addition, webbing is often added in an attempt to offset any structural instability that may develop as a result of the collapsibility feature, thus providing additional stability along the length of the frame. Even those frames or trusses that are not designed to collapse or fold implement intermediate webbing to obtain increased stability. The intermediate webbing generally occupies the internal channel or space defined by elongated cylindrical, tubular or rectangular principal frame segments, with the webbing generally extending the length of the column or truss intermittently fixed to these tubing segments.

U.S. Pat. Nos. 5,351,843, 5,822,945, and 6,149,021 each define columns or trusses that are designed to be easily folded for portable display systems. Each of the patents discloses a column-like structure of elongated shape with various diagonal webbings. U.S. Pat. Nos. 5,711,131 and 6,079,178 disclose elongated truss structures for use in display systems, where the column-like structures are not collapsibly portable. Instead, intermediate webbing is provided for stability, and in the case of the '178 patent, for easier stackability.

Intermediate webbing, such as those described above, are a result of conventional notions of what is required in order to increase stability for these column-like structures. Since these elongated structures are often necessarily narrow, webbing has been seen as a way of distributing the weight throughout the frame to prevent buckling while at the same time eliminating the need for a solid-bodied structure that would be difficult to transport, heavy, difficult to manipulate, and thus contrary to the multiple configuration requirements of portable display construction and design. Despite the popularity of these conventional intermediate webbing techniques, there are inherent drawbacks.

First, intermediate webbing increases the manufacturing and material costs of the frames. Second, webbing can be aesthetically unattractive. A distractive and industrial-looking webbed frame structure diminishes the appearance of the overall display, and ultimately draws the human eye toward these complicated structures and away from what displayers want a potential client to focus in on, namely the graphics and display materials. Third, webbing significantly limits the placement options for those appurtenances with attachment means that extend around the principal frame segments. The intermediate webbing is connecting to the tubing segments at a plurality of connection points, there are portions of the tubing which are unavailable for removably securing various grasping attachments (i.e., clamps, clips, shrouds, etc.) since many attachment means require unobstructed surfaces in order to wrap around or clamp on to the tubing segments. In an attempt to combat this limitation, frames may be constructed with mounting slots machined into the outer surface of the tubing segments. However, this extra machining will, again, significantly increase the manufacturing costs and the aesthetic unattractiveness of the framing.

Consequently, there is a need for columns and truss structures for use in displays that are aesthetically appealing, and cost efficient. This box frame structure must be substantially free of intermediate webbing and other distractive and space limiting members. In addition, this box frame structure must be of sound structural stability, and capable of selectively securing removable grasping attachments along substantially the entire length of the tubing segments for providing optimal flexibility for incorporating shelves, work tables, video screens, graphic screens and the like. Lastly, the structure must incorporate all of this while at the same time maintaining the ease of construction and configurability required of portable display designs.

SUMMARY OF THE INVENTION

An elongated box frame structure of the present invention comprises a plurality of frame segments with webbing attached to each end of the plurality of frame segments and no webbing intermediate the tubing ends. The plurality of frame segments are attached to the end piece such that a column-like structure is formed. The inner space defined within the frame segments is substantially free of webbing. Instead, structural strength and stability is achieved by the end webbing. The end of one elongated box frame structure is capable of removably connecting with the end piece of other similar elongated box frame structures to achieve varying framing heights and other dynamic configurations.

The absence of webbing and other cross-membering intermediate the ends is a significant feature and advantage that in itself generates other features and advantages.

A significant feature and advantage of utilizing an elongated box frame assembly free of webbing is that it is aesthetically appealing. Visual appeal is essential in trade show displays and other exhibition environments.

Another significant feature and advantage of eliminating webbing in the present invention is that manufacturing and material costs are significantly reduced since fewer components are required. Reduced components provide a benefit to the end user as well by simplifying assembly and disassembly.

A further feature and advantage of a webbing-free frame structure according to the present invention centers around frame attachments, such as shelving. The absence of space limiting webbing means that there are significantly more attachment and grasping points along the entire length of each frame segment. As a result, a valuable proliferation in configuration options is made available to the end user.

The following U.S. patent applications are being filed by the same applicant on the same day as this application and are hereby incorporated by reference: U.S. patent application Ser. No. 09/953,098, entitled "DISPLAY WITH APPURTENANCE ATTACHMENT"; U.S. patent application Ser. No. 09/953,099, entitled "SCREEN MOUNTING APPARATUS"; U.S. patent application Ser. No. 09/953,113, entitled "MODULAR MULTI-CONFIGURABLE DISPLAY SYSTEM".

DETAILED DESCRIPTION OF PREFERRED EMBODIMENTS

Figure 1:
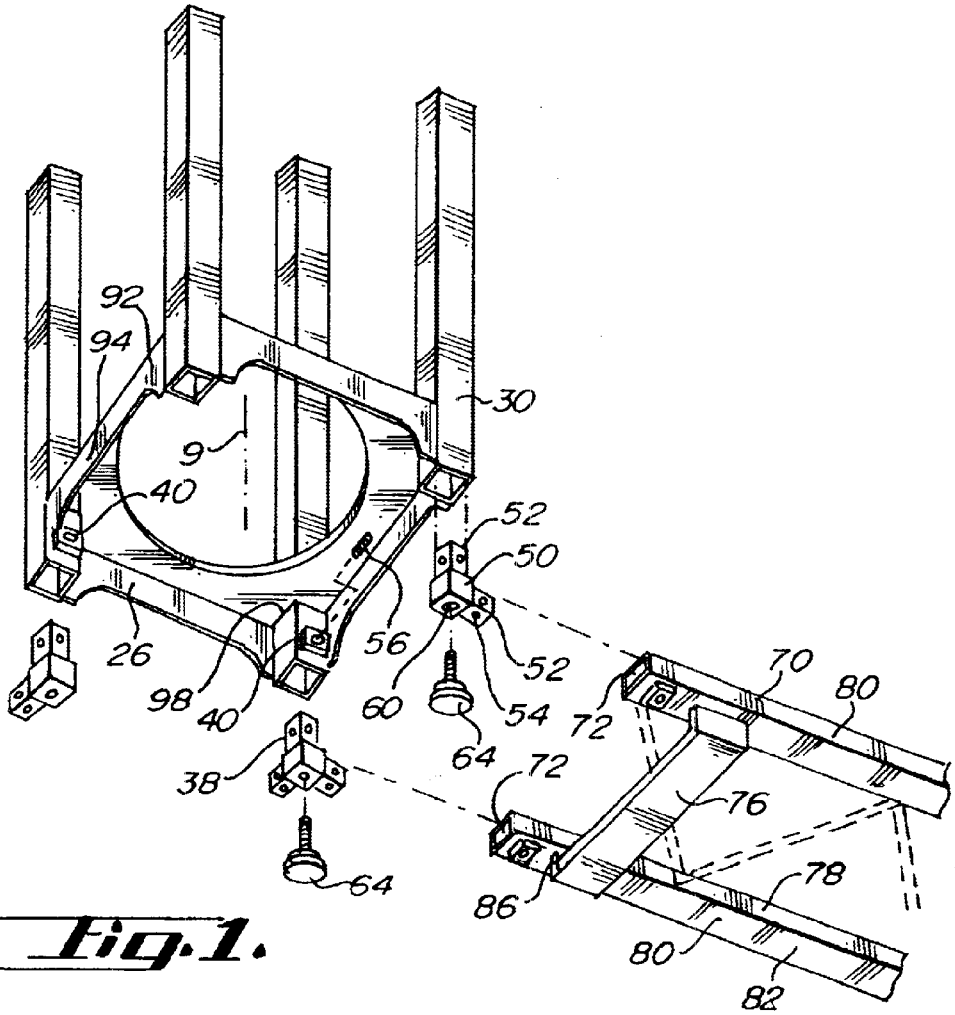
FIG. 1 is an exploded view of the box frame column and box frame truss in accordance with the invention.

Referring to FIGS. 1, 2, 3 and 4, embodiments of the invention are illustrated. Specifically referring to FIG. 2, an elongated box frame 20 is illustrated and is generally comprised of four frame segments 22 all of equal dimensions, and a pair of end webbings 26. Each frame segment has a first end 27 and a second end 28. The frame segments, in this embodiment, extend to a first end 30 and second end 31 of the box frame. Each end of the elongated box frame has connecting portions 32 configured as sockets that are open for receiving male connector portions or connector pieces 38 as illustrated in FIG. 1. Threaded portions 40 configured as nuts are welded onto the ends 44 of the individual frame segments 22.

The connector pieces 38 generally comprise a central body section 50 and arrowed connecting segments 52 which have dimples 54 for assisting positioning of set screws 56. Threaded bores 60 may be utilized to connect threaded feet 64 or other appurtenances.

Referring to FIG. 1 the connectors 38 also engage the horizontal truss member 70. Said truss member similarly has open sockets 72 at the ends of the square tubing for receiving the connector 38. End webbing 76 which is U-shaped in an embodiment which provides complete access to three sides 78 of the truss frame segments 80. The fourth side 82 has access on both sides of the connection point 86 of the U-shaped member to the truss frame segment 80.

Figure 5A:
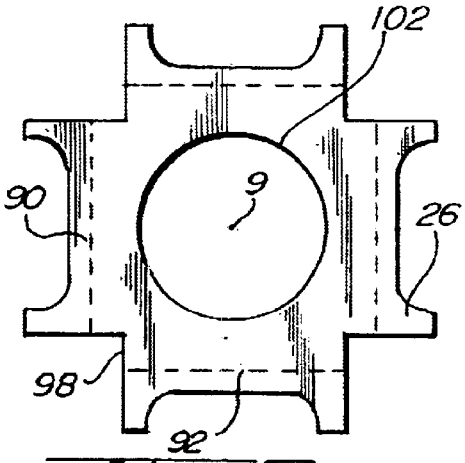
FIG. 5*a* is a plan view of a stamping for forming an end webbing.
Figure 5B:
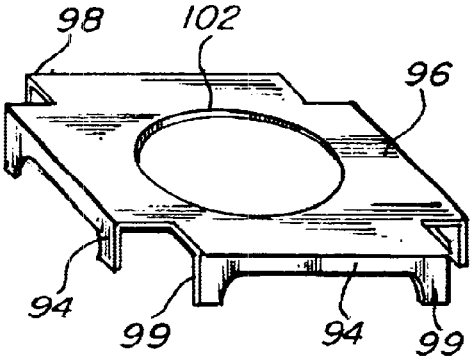
FIG. 5*b* is a perspective view of the piece of FIG. 5*a* suitably bent for an end webbing in accordance with the invention.

Referring to FIGS. 1, 5*a*, and 5*b*, details of the end webbing 26 are illustrated. The end webbing 26 is positioned at the ends 30, 31 of the box frame and is appropriately permanently attached to the box frame segments such as by welding. FIG. 5*a* illustrates a suitable stamping for formation of the end webbing. The dashed lines 90 illustrate the bend lines 92 which join the sides 94 of the webbing to the top surface 96 of the horizontal plate portion 97. The webbing piece has four inset corners 98 for each frame segment and a vertical portion 99, extending parallel to the frame segments, which when welded to the frame segments, significantly enhances the strength of the box frame. A central aperture 102 lightens the structure without significantly reducing the strength of the webbing and further provides an aesthetically pleasing configuration. The box frame has an axis a of which the frame segments and aperture are centered about. Although the end "webbing" as illustrated is formed of a single unitary piece, it is also contemplated that the webbing could be formed of individual strips bridging adjacent frame segments. Thus "webbing" is defined as the structure securing segments together, whether a single unitary piece or multiple pieces.

Figure 6:
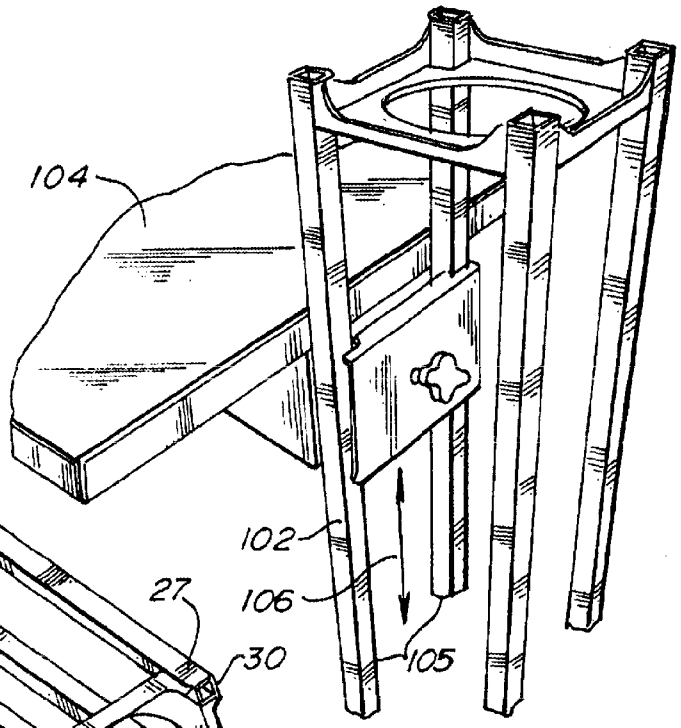
FIG. 6 is a perspective view of a portion of a vertical column member in accordance with the invention herein with a table adjustably mounted hereto.
Figure 2:
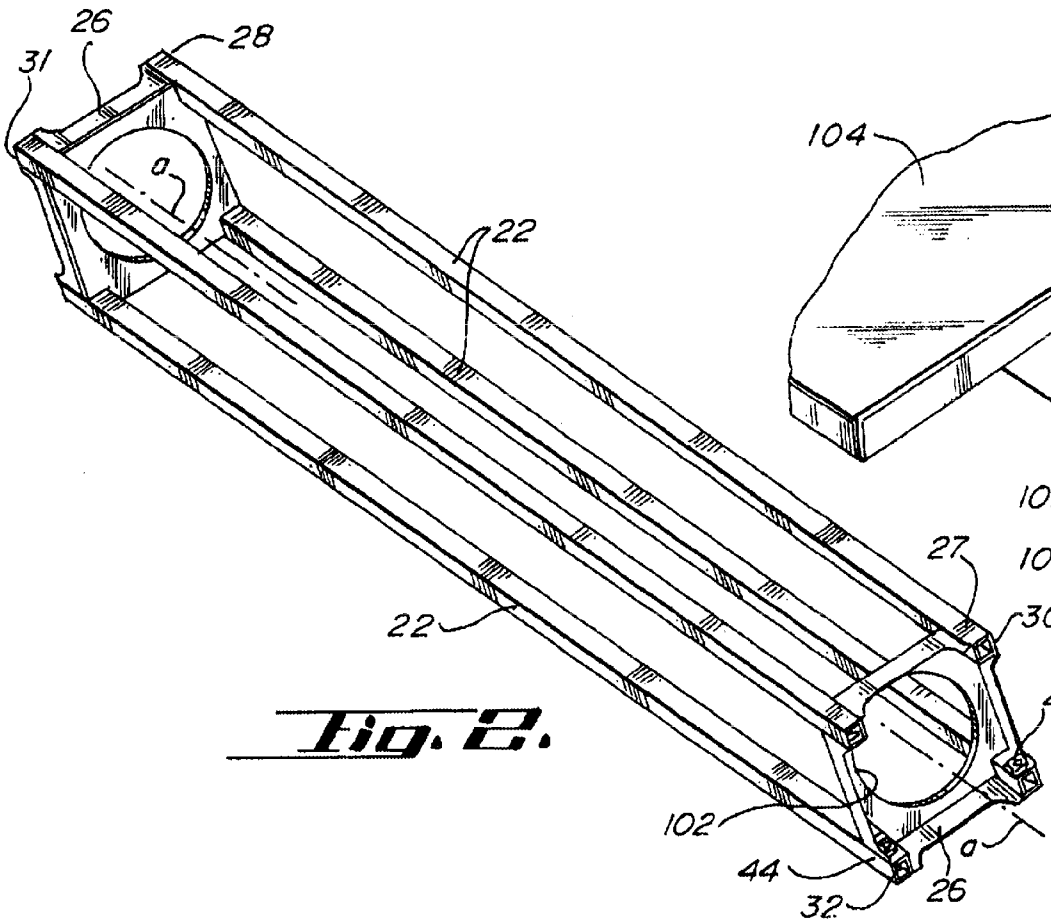
FIG. 2 is a perspective view of a box frame column member in accordance with the invention.
Figure 3:
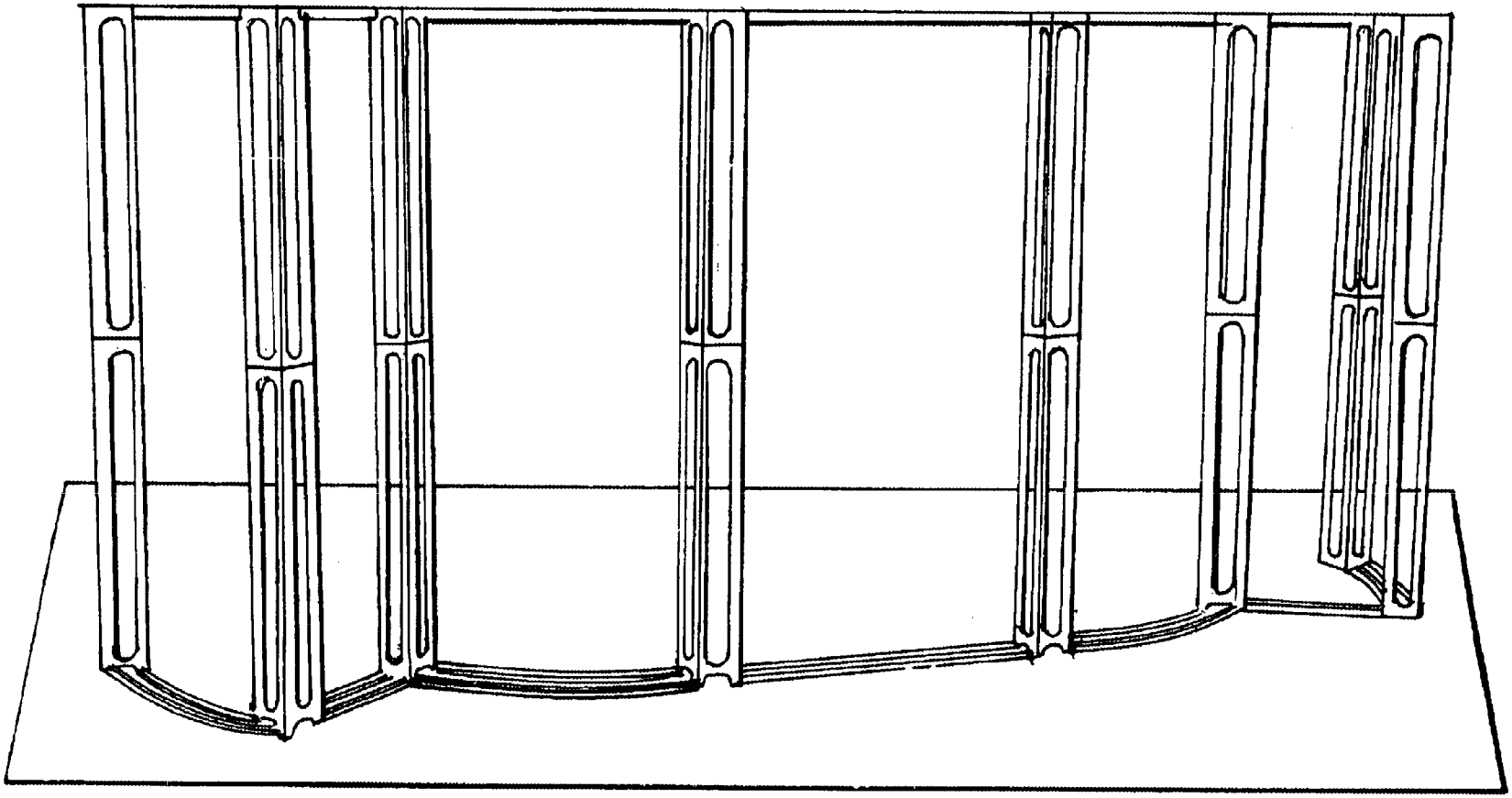
FIG. 3 is a front perspective view of a framework for a display back wall in accordance with the invention.
Figure 4:
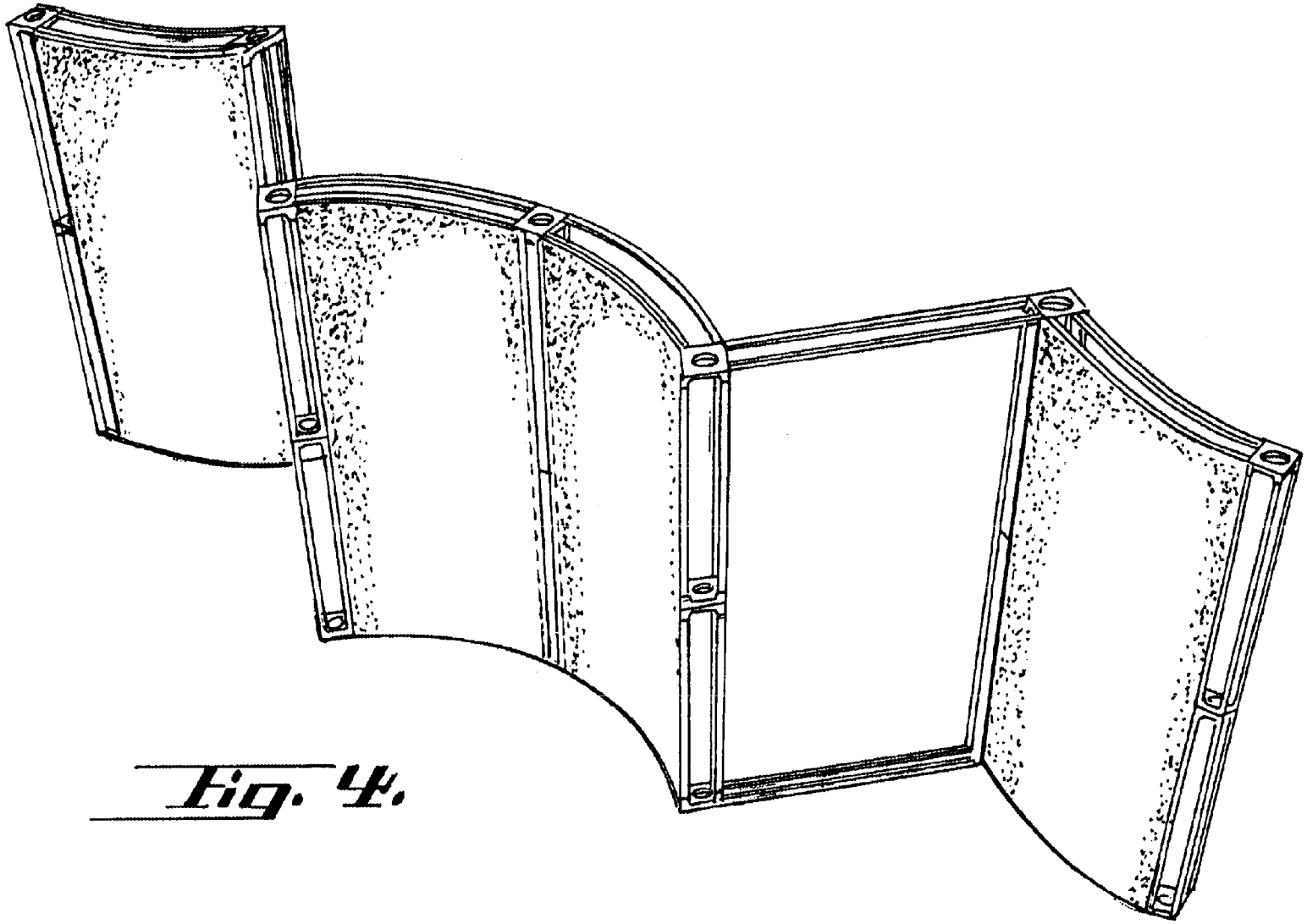
FIG. 4 is a perspective view of a display back wall including graphic display screens.
Figure 8:
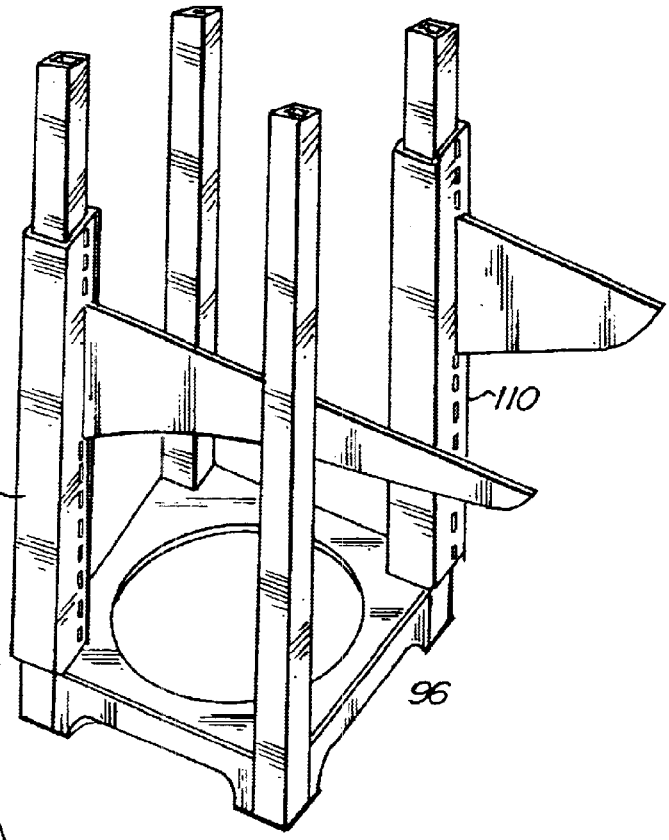
FIG. 8 is a perspective view of a box frame column member and attached appurtenances in accordance with the invention herein.
Figure 7:
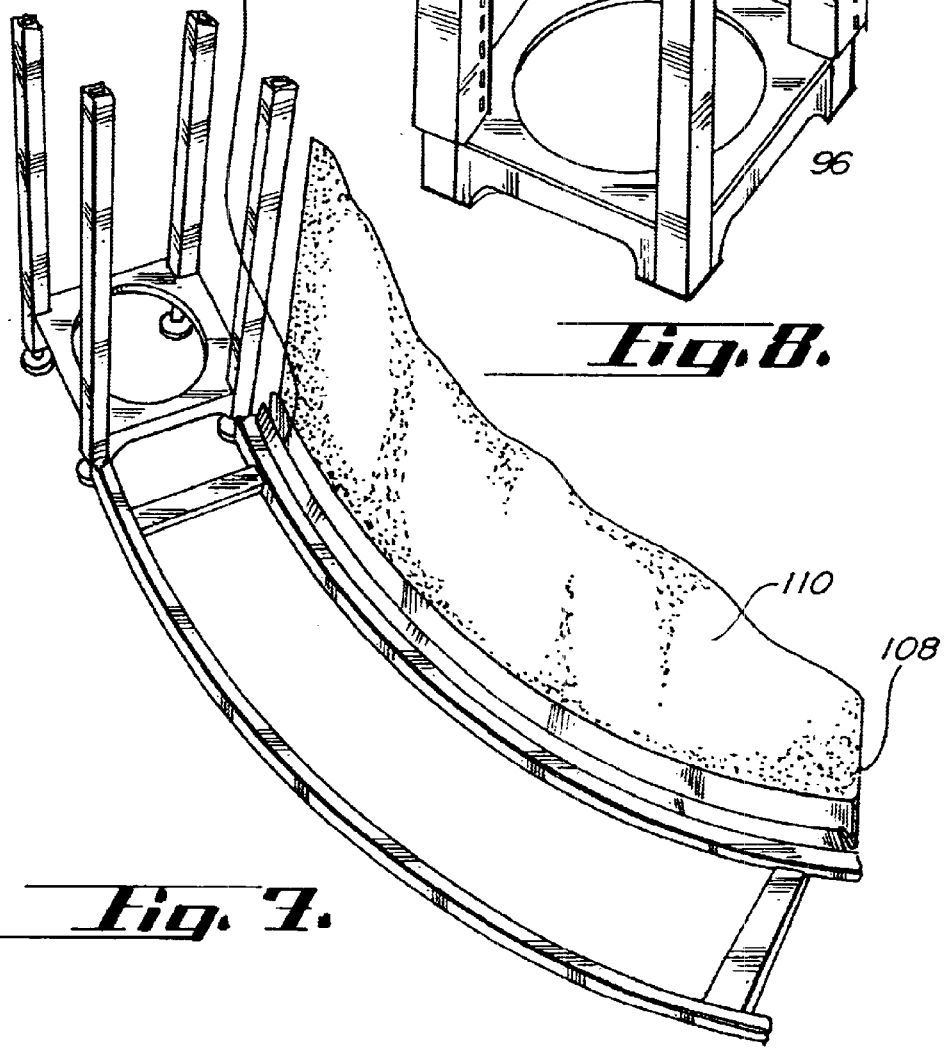
FIG. 7 is a perspective view of the lower portion of a box frame member attached to a truss member with an attached graphic screen in accordance with the invention herein.

Referring to FIGS. 6, 7 and 8, various appurtenances that may be attached to the elongated box frames are illustrated. It is very desirable to be able to attach these appurtenances and others at any desired location intermediate the ends of the box frames. As illustrated in FIG. 6, a table utilizing a clamp for attaching said table 104 to a pair 105 of frame segments along any desired position as indicated by the arrow 106. Significantly, the elongated box frames have an intermediate portion 89 positioned intermediate the box frame ends; said intermediate portion does not have any webbing or bracing. This facilitates four "clean" frame segments for variable positioning of appurtenances, as illustrated in FIGS. 6 and 8, and for providing an aesthetically pleasing and uncluttered look. In an ideal embodiment the clean intermediate portion without webbing will constitute 70 percent or more of the length of the box frame.

FIG. 7 illustrates a screen 110 which is suitably attached by way of individual tabs at the ends 108 or sides of the screen 110. Such an appurtenance and the attachment means thereof are explained in greater detail in the related Applications incorporated by reference described above and filed on the same filing date as this application. FIG. 8 illustrates brackets for holding the appurtenances such as shelves which are attached by way of circumferential hooked bracket attachment sleeves 110. Said sleeves can wrap around the entire length of the box frame to provide an aesthetically pleasing and simple slotted structure for attaching said appurtenance brackets wherever desired, or they can be positioned on specific portions of the frame segments. The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An elongated box frame assembly for use in constructing displays, comprising:

four frame tubing segments, each of the tubing segments having a first end portion and a second end portion; and a first end piece webbing securing the four frame tubing segments at the first end portions, a second end piece webbing securing the four frame tubing segments at the second end portions for fixed attachment to the end portions, the fixed attachment of the end webbings to the end portions of the four frame tubing segments defining an elongated structure of generally columnar shape wherein the structure is substantially without bracing intermediate the end webbings, the first and the second end piece webbings having a top plate and four integral sides, each of the four integral sides being perpendicular to said top plate, and each of the four integral sides spanning between and operably connected to two adjacent tubing segments in a plane parallel to said two adjacent tubing segments for bridging support.

2. The frame assembly of claim 1, wherein the four frame tubing segments are of a general rectangular cross-section.

3. The frame assembly claim 1, wherein each top plate of the first end and second end piece webbings includes a central aperture.

4. The frame assembly of claim 1, wherein each top plate of the first end and second end piece webbings includes four inset corners for attachment to the four tubing segments.

5. The frame assembly of claim 1, wherein the end pieces are fixedly attached to one of the four frame tubing segments using welding techniques.

6. The frame assembly of claim 1, wherein the outer surfaces of the four frame tubing segments are substantially smooth and free of obstructions along the length between the first end portion and the second end portion.

7. The frame assembly of claim 1, wherein the four frame tubing segments are made of a material from a group consisting of: polymeric and metallic.

8. The frame assembly of claim 1, wherein the four frame tubing segments are substantially hollow.

9. The frame assembly of claim 1, wherein the fixed attachment of the end piece webbings to the four frame tubing segments forms a frame assembly removably connectable to a substantially similar second frame assembly.

10. The frame assembly of claim 9, wherein the removable connectability of the frame assemblies is achieved with fastening means.

11. A box frame for a display comprising four elongate frame tubing segments and end webbing connecting the ends, the frame tubing segments arranged as a parallelepiped without bracing intermediate the end webbing, the end webbing having a top plate and four integral sides, each of the four integral sides being perpendicular to said top plate, and each of the four integral sides spacing between and operably connected to two adjacent tubing segments for bridging support, the box frame having a top and a bottom, each box frame having four sockets for receiving connectors for connection to other display components.

12. The box frame of claim 11, wherein the four frame tubing segments are of general rectangular cross-section.

13. The box frame of claim 11, wherein the top plate of the end webbing includes a central aperture.

14. The box frame of claim 11, wherein the top plate of the webbing includes four inset corners for attachment to the four frame tubing segments.

15. A box frame for use in constructing a display, comprising:

a plurality of tubing means, each of the plurality of tubing means having a first end portion and a second end portion;

a first end webbing means securing to the frame tubing means at the first end portions;

a second end webbing means securing the frame tubing means at the second end portions; and the securement of the first and second end webbing means defining an elongated generally columnar frame structure wherein the structure is substantially without bracing intermediate the end webbing means, the first and second end webbing means having a plurality of bend lines forming perpendicular side portions spanning in between and operably connecting to two of the tubing means proximate the end portions to provide bridging support.

16. The box frame of claim 15, wherein each of the end webbing means include four inset corners for attachment to the plurality of tubing means.

17. The box frame of claim 15, wherein each of the end webbing means include a central aperture.

18. The box frame of claim 15, wherein each of the plurality of tubing means are of a general rectangular cross-section.

19. The box frame of claim 15, wherein the outer surfaces of the plurality of tubing means are substantially smooth and free of obstructions along the length between the first end portion and the second end portion.

* * * * *